US008508371B2

(12) United States Patent
Lee et al.

(10) Patent No.: US 8,508,371 B2
(45) Date of Patent: Aug. 13, 2013

(54) MULTI-SECURED RFID ELECTRONIC SEAL

(75) Inventors: Ming-Town Lee, Zhongli (TW); Yu-Cheng Chang, Longtan Township, Taoyuan County (TW)

(73) Assignee: Chung-Shan Institute of Science and Technology, Taoyuan County (TW)

( * ) Notice: Subject to any disclaimer, the term of this patent is extended or adjusted under 35 U.S.C. 154(b) by 431 days.

(21) Appl. No.: 12/947,306

(22) Filed: Nov. 16, 2010

(65) Prior Publication Data

US 2012/0119975 A1 May 17, 2012

(51) Int. Cl.
*G08B 13/14* (2006.01)

(52) U.S. Cl.
USPC ..... 340/572.8; 340/10.1

(58) Field of Classification Search
USPC ..... 340/572.8, 10.1, 5.61
See application file for complete search history.

(56) References Cited

U.S. PATENT DOCUMENTS

2010/0214077 A1* 8/2010 Terry et al. ..... 340/10.4

FOREIGN PATENT DOCUMENTS

| | | |
|---|---|---|
| CN | 2531066 Y | 1/2003 |
| TW | I285700 | 8/2007 |
| TW | I292007 | 1/2008 |
| TW | M328051 | 3/2008 |

* cited by examiner

*Primary Examiner* — Shirley Lu
(74) *Attorney, Agent, or Firm* — Muncy, Geissler, Olds & Lowe, PLLC

(57) ABSTRACT

A multi-secured RFID (Radio Frequency Identification) electronic seal includes a bolt, a bolt pedestal and a RFID system. The bolt has a male bolt portion with an electrical connecting point. The bolt pedestal has a female pedestal portion with several nodes to electrically connect with the electrical connecting point to provide plural selections of connecting and disconnecting. The RFID system includes a RFID chip and a transmission conductor embedded in the bolt, and an antenna installed on the bolt pedestal. When the bolt and the bolt pedestal is securely locked together, whether the RFID chip is electrically connects to the antenna depends on if the electrical connecting point connects a preset node, so that a RFID signal may be selectively transmitted by the RFID chip through the antenna.

12 Claims, 4 Drawing Sheets

MULTI-SECURED RFID ELECTRONIC SEAL

BACKGROUND OF THE INVENTION

1. Field of Invention

The present invention relates to a passive electronic seal and, in particular, to a multi-secured method and device using RFID (Radio Frequency Identification) for security management, control and identification of transported goods and containers during transportation.

2. Related Art

Nowadays, 85% of global trading goods are transported through locked transportation containers; wherein the containers transited through sea transportation, duty-bonded trucks and freight trains are the main streams. Therefore, security monitoring mechanism for preventing transited goods from replacement or theft during transportation is a major issue to facilitate fast and smooth global trading. Currently, most of the anti-theft and anti-replacement designs still rely on conventional locking systems such as mechanical locks, spring locks and mechanic seal. These locking tools are printed with goods' serial numbers at the sealing or latching portions, which have to be eye-checked and make sure the appearance still complete as a whole. However, the mechanical structures and the serial numbers printed on the appearances of the locking tools mentioned above are very easy to be duplicated through modern arts, without leaving any evidence during the duplication. Since eye-checking is not able to differentiate the true and the false ones, such locking tools cannot achieve a satisfied protection for the transited goods. These conventional locking tools do not have electronic information implied thereon and become a severe bottle neck of the demands on globalized logistics and reduction of transportation cost.

Therefore, in the recent years after RFID (Radio Frequency Identification) chip development becoming more mature, some technologies regarding electronic locks (or electronic seal, simply called e-seal) that use unduplicated RFID chip and are incorporated with conventional mechanical seal have been patented. The electronic seal used on transportation containers may be classified as active electronic locks and passive electronic locks according to whether there exists an extra battery supplying power to the RFID chip. Active electronic lock has complicated internal structures and high manufacturing cost, and generally will be recycled for reuse accordingly. Since the active electronic lock has an extra battery supply power, warning signals may be sent automatically during unauthorized open operation or damages. As to the passive electronic lock, since the structure is relatively simple and there is no extra battery supplying extra power, the operating principle is to receive the electromagnetic power transmitted from external RFID readers, stimulate the RFID chip inside the passive electronic lock, and then use the received electromagnetic power to transmit identification data of RFID chip backwards as a responded electromagnetic signal, thereby facilitating a data exchanging operation.

As mentioned in the above paragraph, the method of applying the passive electronic seal (hereafter use electronic seal) for transportation containers is to combine the conventional mechanical seals and RFID chip, the announced patents as disclosed in Taiwan R.O.C. Patent No. 1285700, M328051 and 1292007, as well as China Patent No. CN2531066Y. The emphasized points are to use the general principle that the RFID chip must have a connecting line to connect with its antenna so that the RFID chip is capable of receiving and transmitting signals. The RFID chip and the antenna will be wrapped up separately in a pair of a bolt and a corresponding bolt pedestal of conventional mechanical seal, or disposed jointly in one of two ends of either the bolt or the bolt pedestal. When the bolt and the bolt pedestal is engaged and locked with each other on a door latch of a transportation container, the RFID chip and its antenna will be electrically connected and become a reliable reference by communicating with an external RFID reader to determine if the door latch is opened after being locked. However, the locking mechanism of such electronic container seal is to use a spring fastener inside the bolt pedestal to fasten a slot on the bolt. Such slot is easily to be smoothened by an external force or the spring fastener may be removed out by simple tools, and after these damage operations the bolt and the bolt pedestal can still be adhered tightly by glue or adhesive tape without evidences left on the appearances. In the past, such damage operation may be discovered by physically pulling and dragging of the investigation officers. Yet ever since the fast-passing policy of the customs clearance, investigation is simplified or negligence of investigation is occurred due to trusts on the RFID technology. Therefore, using the single connection between RFID chip and its antenna to transmit electronic signals as a locking mechanism is only a little bit advanced than using merely the conventional mechanical locks. In such circumstance, repeatedly using the electronic seal or using a simple conductive material as a bridge to connect with the RFID chip and its antenna becomes easily-unsecured connections without leaving any tracking record thereon. Thus, using this passive RFID electronic seal becomes a major security problem.

Therefore, how to improve the security during container transportation, how to enhance the identiability of container transportation and reduce the waste of manpower and time, becomes a major technical problems for the transportation industry deemed to be urgently resolved.

SUMMARY OF THE INVENTION

Accordingly, the present invention provides a multi-secured RFID electronic seal, which has adjustable electrical connecting point(s) of a male bolt portion, and a female pedestal portion. The female pedestal portion includes one or more nodes electrically connecting with the electrical connecting point(s) of the male bolt portion. Each of the connecting point corresponding to a signal transmission path, thereby achieve a high security and anti-false design.

In an embodiment, a multi-secured RFID electronic seal includes a bolt, a bolt pedestal and a RFID system. The bolt has a male bolt portion and the male bolt portion has one or more electrical connecting points. The bolt pedestal has a female pedestal portion correspondingly receiving the male bolt portion of the bolt to securely lock with each other. The female pedestal portion has several nodes therein to electrically connect with the electrical connecting point of the male bolt portion. Each of the nodes electrically connects to a corresponding signal transmission path. The RFID system includes a RFID chip, a transmission conductor and an antenna. The RFID chip is embedded inside the bolt. The transmission conductor electrically connects with the RFID chip and the electrical connecting point(s) of the male bolt portion. The antenna is installed on the bolt pedestal and is electrically connected with one or more of the nodes through the signal transmission path. After the bolt and the bolt pedestal is securely locked with each other, the RFID chip selectively and electrically connects through the transmission conductor, the electrical connecting point of the male bolt portion to one or more of the nodes, so that a corresponding RFID signal can be transmitted through one of the corresponding signal transmitting paths and then the antenna.

In an embodiment, a multi-secured RFID electronic seal includes a bolt, a bolt pedestal, a RFID system and a protection circuit. The bolt has a male bolt portion and the male bolt portion has one or more electrical connecting points. The bolt pedestal has a female pedestal portion correspondingly receiving the male bolt portion of the bolt to securely lock with each other. The female pedestal portion has several nodes therein to electrically connect with the electrical connecting point of the male bolt portion. The RFID system includes a RFID chip, a transmission conductor and an antenna. The RFID chip is embedded inside the bolt. The transmission conductor electrically connects with the RFID chip and the electrical connecting point of the male bolt portion. The antenna is installed on the bolt pedestal and is electrically connected with one or more of the nodes. The protection circuit electrically connects the RFID chip and the antenna after the bolt and the bolt pedestal is securely fastened; wherein when the bolt and the bolt pedestal is separated after being securely fastened, the protection circuit becomes disconnected so that the RFID chip fails to electrically connect with the antenna.

In an embodiment, a multi-secured protection method of a RFID electronic seals also disclosed. The multi-secured protection method includes the following steps: (A) Provide a bolt with a male bolt portion. The male bolt portion has one or more electrical connecting point. (B) Provide a bolt pedestal with a female pedestal portion. The bolt pedestal correspondingly receives the male bolt portion of the bolt to securely lock with each other. The female pedestal portion has plural nodes therein to electrically connect with the electrical connecting point(s) of the male bolt portion; each of the nodes electrically connects with a corresponding signal transmission path respectively. (C) Provide a RFID system. The RFID system has a RFID chip embedded inside the bolt, a transmission conductor electrically connecting with the RFID chip and the electrical connecting point of the male bolt portion, and an antenna installed on the bolt pedestal and electrically connecting with one or more of the nodes through the corresponding signal transmission path; wherein after the bolt and the bolt pedestal is securely locked with each other, the RFID chip selectively and electrically connects through the transmission conductor, the electrical connecting point of the male bolt portion to at least one of the nodes, so that a corresponding RFID signal can be transmitted through one of the corresponding signal transmitting paths and then the antenna.

Through the provided embodiments, functions including multi-security connection and unrepeated usage will be completed to achieve effects of antitheft and anti-false during transportation.

Preferred embodiments of the present invention and efficacies thereof will be illustrated in detail below with the accompanying drawings.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
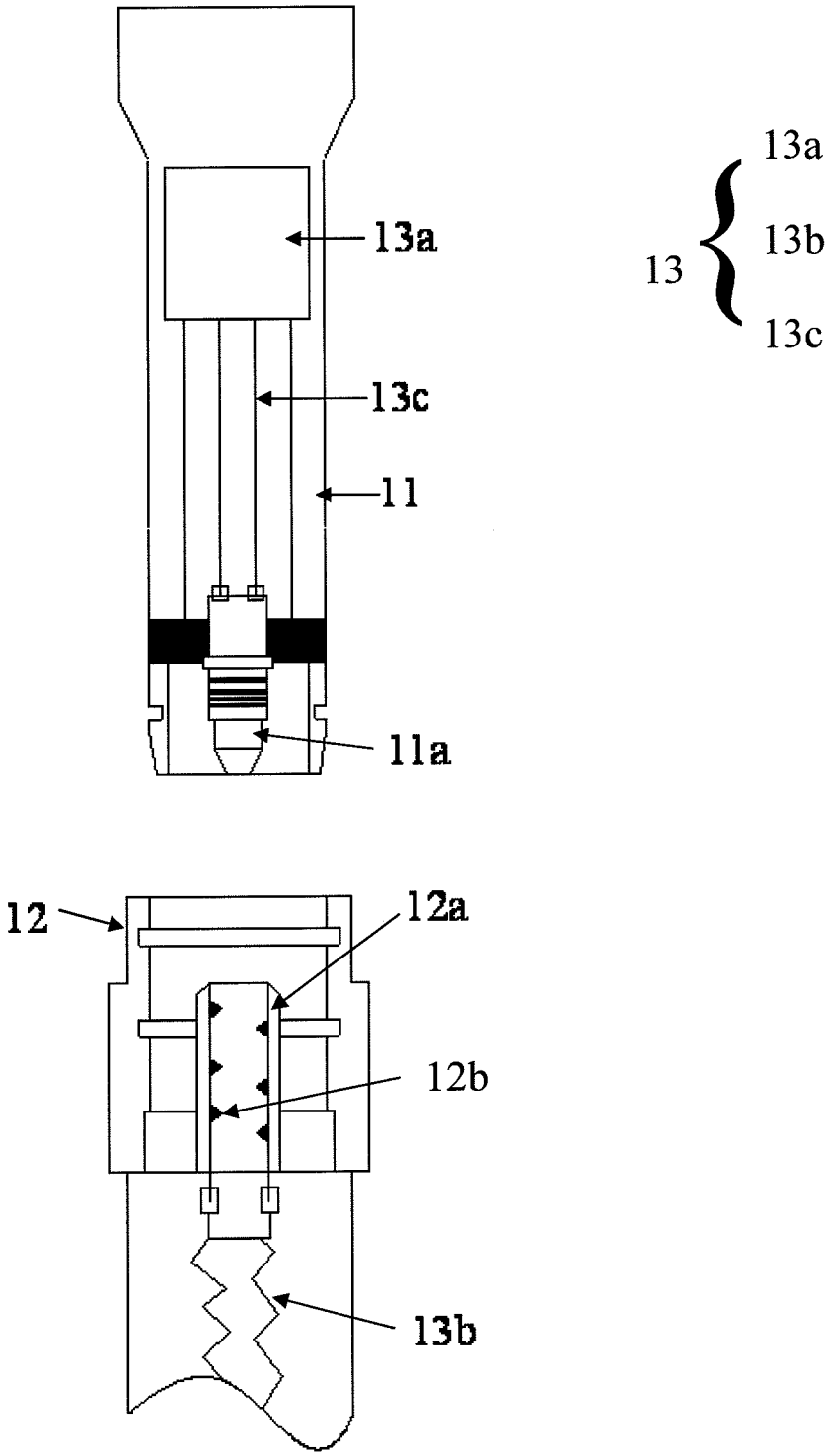
FIG. 1 is an explanatory structural diagram of a multi-secured passive RFID (Radio Frequency Identification) electronic seal according to an embodiment of the present invention.

Referring to FIG. 1, which is an explanatory structural diagram of a multi-secured RFID electronic seal according to an embodiment of the present invention. As shown in the drawing, the multi-secured RFID electronic seal mainly includes a bolt 11, a bolt pedestal 12, and a RFID system 13.

The bolt 11 has a male bolt portion 11*a*. The male bolt portion 11*a* includes one or more electrical connecting points (not shown); the male bolt portion 11*a* may be embedded on an insulator without connecting to a ground. The bolt pedestal 12 has a female pedestal portion 12*a* correspondingly receiving the male bolt portion 11*a* of the bolt 11 to securely lock with each other. When the female pedestal portion 12*a* and the male bolt portion 11*a* of the bolt 11 are securely lock with each other, the female pedestal portion 12*a* has plural nodes 12*b* therein to selectively connect with one or more electrical connecting points of the male bolt portion 11*a*. Each of the nodes 12*b* electrically connects to a corresponding signal transmission path (not shown). The signal transmission path is a signal cable, or a set of electrical traces on a printed circuit board or on a flexible circuit board. The RFID system 13 includes a RFID chip 13*a*, an antenna 13*b* and a transmission conductor 13*c*. The RFID chip 13*a* is embedded in the bolt 11; the transmission conductor 13*c* electrically connects the RFID chip 13*a* with one or more electrical connecting point of the male bolt portion 11*a*. (For one electrical connecting point, if it is connected with the node 12*b*, the communication of the RFID system 13 is connected as well; namely the RFID chip 13*a* is connected with the antenna 13*b*. For plural electrical connecting points, those not connected with the transmission conductor 13*c* means the RFID system 13 are disconnected internally, and those connected with the transmission conductor 13*c* means the RFID system 13 are well connected internally. Or, if a preset one of the electrical connecting points is connected with a preset one of the nodes 12*b*, the RFID system 13 is well connected internally; otherwise, the RFID system 13 is disconnected internally. The antenna 13*b* is installed on the bolt pedestal 12, electrically connecting with at least one of the nodes 12*b* through the signal transmission path.

All the plural nodes 12*b* may all be connected to the antenna 13*b* through the signal transmission paths respectively. In another case, if certain ones of the signal transmission paths are not connected with both the corresponding nodes 12*b* and the antenna 13*b*, communications between the nodes 12*b* and the antenna 13*b* are disconnected. In another case, if a preset one of the signal transmission paths are not connected with both the corresponding nodes 12*b* and the antenna 13*b*, communications between the nodes 12*b* and the antenna 13*b* are disconnected.

After the bolt 11 and the bolt pedestal 12 are securely fastened with each other, the RFID chip 13*a* would be able to selectively and electrically connect through the transmission conductor 13*c*, the electrical connecting point(s) of the male bolt portion 11*a* to the nodes 12*b*, as well as further electrically connecting with the corresponding signal transmission path(s) and to the antenna 13*b*. Therefore the RFID chip 13*a* can send a RFID signal through the route above from the transmission conductor 13*c* to the antenna 13*b*. When a preset one of the electrical connecting points of the male bolt portion 11*a* is connected with a preset one of the nodes 12*b* of the female pedestal portion 12*a* with its corresponding signal transmission path effectively connected, the RFID system 13 may transmit the RFID signal through the corresponding signal transmission path. When a non-preset one of the electrical connecting points of the male bolt portion 11*a* is connected with a preset one of the nodes 12*b* of the female pedestal portion 12*a* with its corresponding signal transmission path effectively-connected, the RFID system 13 is disconnected internally. Therefore, through the various combinations between the electrical connecting point(s) of the male bolt portion 11*a* and the nodes 12*b* of the female pedestal portion 12*a,* and between the nodes 12*b* of the female pedestal portion 12*a* and the corresponding signal transmission path(s), a high-security and outstanding anti-false design is achieved.

Figure 2:
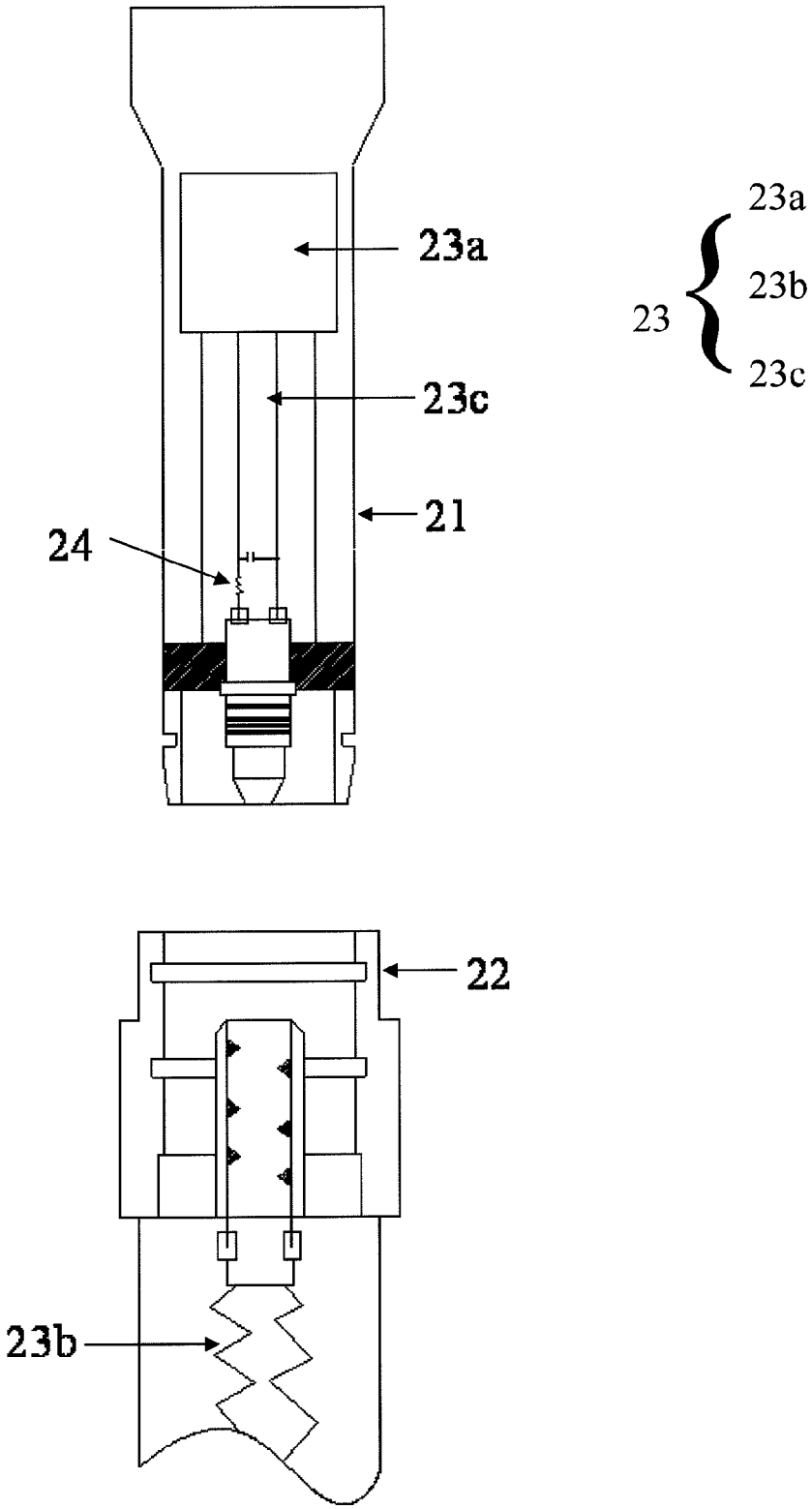
FIG. 2 is an explanatory structural diagram of a multi-secured passive RFID electronic seal according to a second embodiment of the present invention.

FIG. 2 is an explanatory structural diagram of a multi-secured RFID electronic seal according to another embodiment of the present invention. The multi-secured RFID electronic seal includes a bolt 21, a bolt pedestal 22, and a RFID system 33 and a protection circuit 24. The bolt 21 and the bolt pedestal 22 may be securely locked with each other. The RFID system 23 includes a RFID chip 23*a,* an antenna 23*b* and a transmission conductor 23*c*. The RFID chip 23*a* and the transmission conductor 23*c* are electrically connected with each other and are both embedded in the bolt 21. The protection circuit 24 is also embedded inside the bolt 11 and is electrically connected between the transmission conductor 23*c* and the male bolt portion 11*a*. When the bolt 21 and the bolt pedestal 22 are securely fastened with each other, the protection circuit 24 electrically connects with the RFID chip 23*a* and the antenna 23*b*. The protection circuit may be a non-symmetrical impedance circuit (selectively realized on any type of circuit board). when the bolt 21 and the bolt pedestal 22 is separated after being securely fastened, the protection circuit 24 become disconnected so that the RFID chip 23*a* fails to electrically connect with the antenna 23*c*. In another case, the protection circuit may be embedded inside the bolt pedestal and electrically connects between at least one of the nodes in the female pedestal portion and the antenna. Since the disconnected protection circuit 24 makes the multi-secured RFID electronic seal unable to be repeatedly used, a high-security and outstanding anti-false design is achieved.

Figure 3:
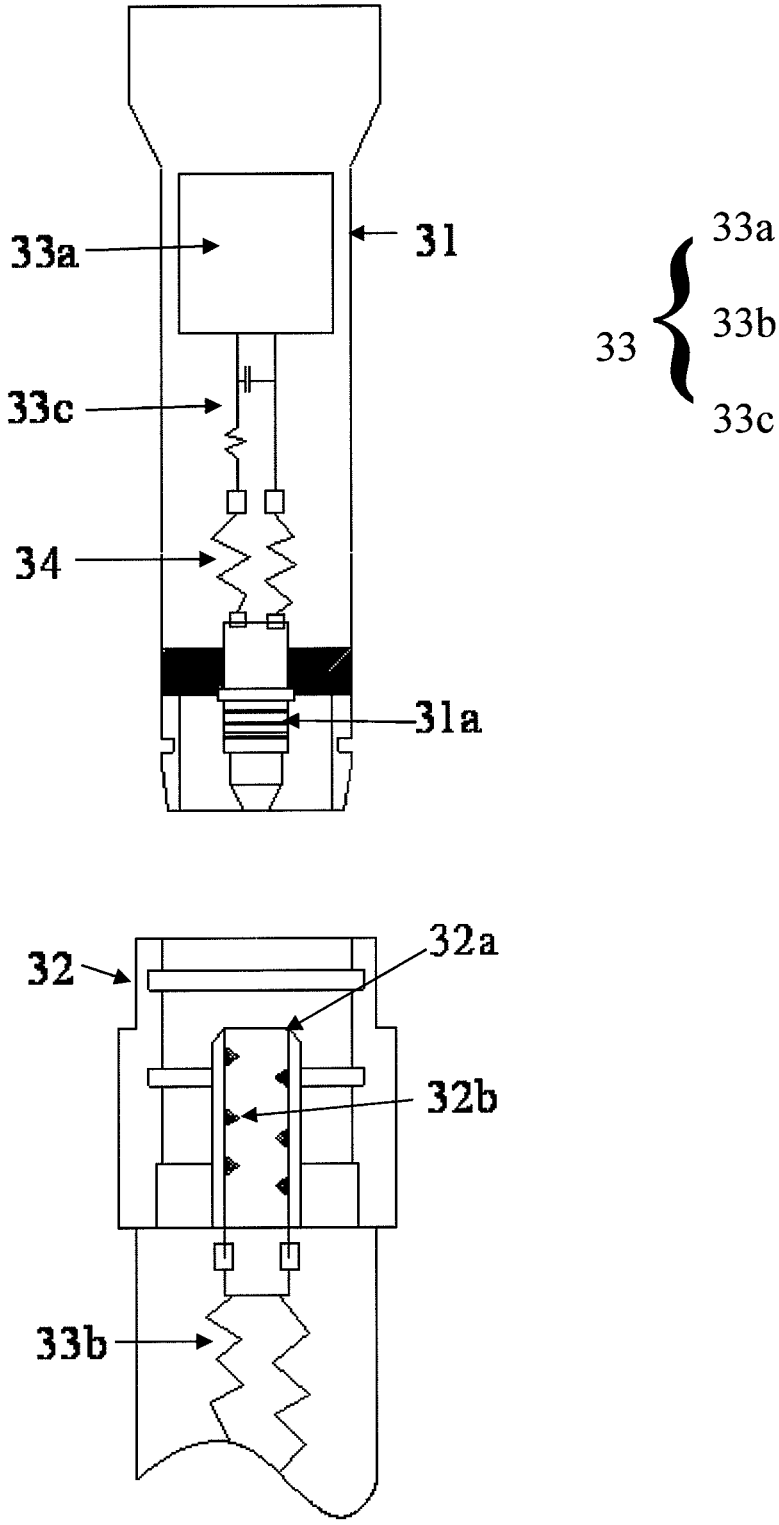
FIG. 3 is an explanatory structural diagram of a multi-secured passive RFID electronic seal according to another embodiment of the present invention.

FIG. 3 is an explanatory structural diagram of a multi-secured RFID electronic seal according another embodiment of the present invention. The multi-secured RFID electronic seal includes a bolt 31, a bolt pedestal 32, a RFID system 33 and a protection circuit 34. The bolt 31 has a male bolt portion 31*a* with one or more electrical connecting points (not shown). The bolt 31 and the bolt pedestal 32 may be securely fastened with each other. Similarly, The bolt 31 has a male bolt portion 31*a* with one or more electrical connecting points; the bolt pedestal has a female pedestal portion 32*a* with plural nodes 32*b* to electrically connect with at least one electrical connecting point of the male bolt portion 31*a*. The RFID system 33 includes a RFID chip 33*a,* an antenna 33*b* and a transmission conductor 33*c*. The RFID chip 33*a* and the transmission conductor 33*c* are electrically connected with each other and are both embedded in the bolt 31. The protection circuit 34 is also embedded inside the bolt 31 and is electrically connected between the transmission conductor 33*c* and the male bolt portion 31*a*. When the bolt 31 and the bolt pedestal 32 are securely fastened with each other, the protection circuit 34 electrically connects with the RFID chip 33*a* and the antenna 33*b*.

The major difference is that one or more of the nodes 32*b* inside the female pedestal portion 32*a* has a hook structure (not shown). After the male bolt portion 31*a* of the bolt 31 and the female pedestal portion 32*a* are securely fastened with each other, the hook structure on at least one of the nodes 32*b* will hook on at least a portion of the protection circuit 34 in the male bolt portion 31*a*. When the bolt 31 and the bolt pedestal 32 is separated after being securely fastened, the hook structure hooks to disconnect the protection circuit 34 on the male bolt portion 31 upon the operation that the bolt 31 is forced to be removed from the female pedestal portion 32. Apparently, the disconnected protection circuit 34 makes the multi-secured RFID electronic seal unable to be repeatedly used again, so a high-security and outstanding anti-false design is achieved.

Figure 4:
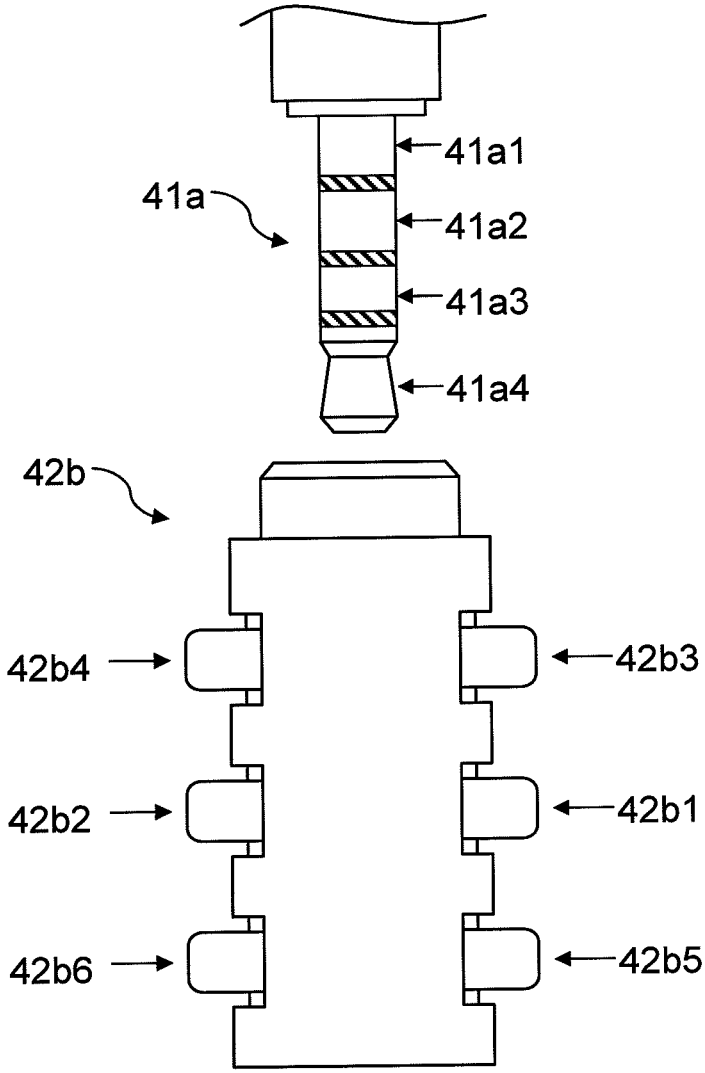
FIG. 4 is an explanatory structural diagram of a multi-secured passive RFID electronic seal according to another embodiment of the present invention.

Refer to FIG. 4, which is an explanatory structural diagram of a variable multi-secured passive RFID electronic seal according to another embodiment of the present invention. The major difference is that a male bolt portion 41*a* has four electrical connecting points 41*a*1, 41*a*2, 41*a*3 and 41*a*4 matching with a female pedestal portion 42*b* with six nodes 42*b*1, 42*b*2, 42*b*3, 42*b*4, 42*b*5 and 42*b*6. The four electrical connecting points 41*a*1, 41*a*2, 41*a*3 and 41*a*4 and the six nodes 42*b*1, 42*b*2, 42*b*3, 42*b*4, 42*b*5 and 42*b*6 may have multiple variable sets of connecting options between the RFID chip and the antenna (both not shown). In an embodiment, the lower two sets 42*b*5 & 42*b*1-42*b*6 & 42*b*2 of the electrical connecting points and nodes may be connected together to provide a wider contact surface, thereby ensure a greater connecting point. When the male bolt is inserted into the female pedestal portion, the multiple variable sets of electrical connecting points and nodes may be connected intentionally before manufacture (e.g. push and make any of the nodes to move into the female pedestal portion and electrically contact with any of the electrical connecting points; the connecting variety may also depend on the position of connecting points of male bolt). There may be corresponding signal transmission paths hidden inside the female pedestal portion and connecting with the antenna and the nodes. Therefore, variable electronic reading or connecting effects may be achieved to approach a maximum security connection.

According to the embodiments disclosed above, a multi-secured protection method of a RFID electronic seal is also disclosed in parallel. The multi-secured protection method of the RFID electronic seal includes the following steps (yet not limited to the sequence of the following steps):

Step A: Provide a bolt with a male bolt portion. The male bolt portion has one or more electrical connecting points.

Step B: Provide a bolt pedestal with a female pedestal portion. The bolt pedestal correspondingly receives the male bolt portion of the bolt to securely lock with each other. The female pedestal portion has plural nodes therein to electrically connect with the electrical connecting points of the male bolt portion; each of the nodes electrically connects with a corresponding signal transmission path respectively Step C: Provide a RFID system. The RFID system has a RFID chip embedded inside the bolt, a transmission conductor electrically connecting with the RFID chip and the electrical connecting point of the male bolt portion, and an antenna installed on the bolt pedestal and electrically connecting with one or more of the nodes through the corresponding signal transmission path; wherein after the bolt and the bolt pedestal is securely locked with each other, the RFID chip selectively and electrically connects through the transmission conductor, the electrical connecting point of the male bolt portion to at least one of the nodes, so that a corresponding RFID signal can be transmitted through one of the corresponding signal transmitting paths and then the antenna.

In another embodiment, the multi-secured protection method further includes the following step: Provide a protection circuit. The protection circuit electrically connects with the RFID chip and the antenna after the bolt and the bolt pedestal is securely fastened; wherein when the bolt and the bolt pedestal is separated after being securely fastened, the protection circuit become disconnected so that the RFID chip fails to electrically connect with the antenna.

In another embodiment, the multi-secured protection method further includes the following step: Provide a hook structure on at least one of the nodes. The hook structure hooks on the protection circuit of the male bolt portion so that the hook structure hooks and disconnects the protection circuit on the male portion when the bolt is forced to be removed from the female pedestal portion.

While the present invention has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A multi-secured RFID electronic seal comprising: a bolt with a male bolt portion, the male bolt portion having at least one electrical connecting point; a bolt pedestal with a female pedestal portion, correspondingly receiving the male bolt portion of the bolt to securely lock with each other, the female pedestal portion having a plurality of nodes therein to electrically connect with the electrical connecting point of the male bolt portion; a RFID system, comprising: a RFID chip embedded inside the bolt; a transmission conductor, electrically connecting with the RFID chip and the electrical connecting point of the male bolt portion; and an antenna installed on the bolt pedestal, electrically connecting with at least one of the nodes; a protection circuit, electrically connecting with the RFID chip and the antenna after the bolt and the bolt pedestal being securely fastened; wherein when the bolt and the bolt pedestal is separated after being securely fastened, the protection circuit become disconnected so that the RFID chip fails to electrically connect with the antenna;

wherein after the bolt and the bolt pedestal is securely fastened, the RFID chip selectively and electrically connects with at least one of the nodes through the transmission conductor, the electrical connecting point of the male bolt portion and the protection circuit, so that the RFID chip transmits a RFID signal through a corresponding one of the signal transmission path and then the antenna.

2. The multi-secured RFID electronic seal of claim 1, wherein the male bolt portion comprises plural ones of the electrical connecting points, when a preset one of the nodes is not electrically connected with a preset one of the electrical connecting point, the RFID chip is disconnected with the antenna.

3. The multi-secured RFID electronic seal of claim 1, wherein the protection circuit is embedded inside the bolt and electrically connects between the transmission conductor and the male bolt portion.

4. The multi-secured RFID electronic seal of claim 1, wherein the protection circuit is embedded inside the bolt pedestal and electrically connects between at least one of the nodes in the female pedestal portion and the antenna.

5. The multi-secured RFID electronic seal of claim 1, wherein at least one of the nodes comprises a hook structure.

6. The multi-secured RFID electronic seal f claim 5, wherein the hook structure hooks on the protection circuit of the male bolt portion so that the hook structure hooks to disconnect the protection circuit on the male bolt portion when the bolt is forced to be removed from the female pedestal portion.

7. The multi-secured RFID electronic seal of claim 1, wherein the protection circuit is a non-symmetrical impedance circuit.

8. The multi-secured RFID electronic seal of claim 1, wherein each of the nodes electrically connects with a corresponding signal transmission path respectively and at least one of the signal transmission paths electrically connects with the antenna.

9. The multi-secured RFID electronic seal of claim 8, wherein when a preset one of the electrical connecting points of the male bolt portion is connected with a preset one of the nodes of the female pedestal portion with its corresponding signal transmission path effectively-connected, the RFID system may transmit the RFID signal through the corresponding signal transmission path.

10. The multi-secured RFID electronic seal of claim 8, wherein at least one of the nodes connects to a disconnected one of the signal transmission paths.

11. A multi-secured protection method of a RFID electronic seal comprising the steps of: providing a bolt with a male bolt portion, the male bolt portion having at least one electrical connecting point; providing a bolt pedestal with a female pedestal portion, the bolt pedestal correspondingly receiving the male bolt portion of the bolt to securely lock with each other, the female pedestal portion having a plurality of nodes therein to electrically connect with the electrical connecting point of the male bolt portion, each of the nodes electrically connecting with a corresponding signal transmission path respectively; and providing a RFID system, the RFID system having a RFID chip embedded inside the bolt, a transmission conductor electrically connecting with the RFID chip and the electrical connecting point of the male bolt portion, and an antenna installed on the bolt pedestal and electrically connecting with at least one of the nodes through the corresponding signal transmission path; wherein after the bolt and the bolt pedestal is securely locked with each other, the RFID chip selectively and electrically connects through the transmission conductor, the electrical connecting point of the male bolt portion to at least one of the nodes, so that a corresponding RFID signal can be transmitted through one of the corresponding signal transmitting paths and the then antenna;

the multi-secured protection method further comprising the step of: providing a protection circuit, the protection circuit electrically connecting with the RFID chip and the antenna after the bolt and the bolt pedestal being securely fastened, wherein when the bolt and the bolt pedestal is separated after being securely fastened, the protection circuit become disconnected so that the RFID chip fails to electrically connect with the antenna.

12. The multi-secured protection method of claim 11 further comprising the step of:

providing a hook structure on at least one of the nodes, the hook structure hooking on the protection circuit of the male bolt portion so that the hook structure hooks and disconnects the protection circuit on the male portion when the bolt is forced to be removed from the female pedestal portion.

* * * * *